United States Patent [19]

Cheshire et al.

[11] Patent Number: 4,498,956

[45] Date of Patent: * Feb. 12, 1985

[54] APPARATUS AND METHOD FOR THE MANUFACTURE OF A NON-WOVEN FIBROUS WEB

[75] Inventors: James O. Cheshire, Neenah; Douglas L. Lindgren, Appleton; Robert J. Marinack, Oshkosh; Bruce W. Janda, Neenah; Robert S. Thut, Green Bay; John T. Larkey, Green Bay; Ray E. Jostad, Green Bay, all of Wis.

[73] Assignee: James River-Norwalk, Inc., Norwalk, Conn.

[ * ] Notice: The portion of the term of this patent subsequent to Apr. 17, 2001 has been disclaimed.

[21] Appl. No.: 540,566

[22] Filed: Oct. 11, 1983

Related U.S. Application Data

[60] Continuation of Ser. No. 305,738, Sep. 25, 1981, Pat. No. 4,443,297, which is a division of Ser. No. 179,229, Aug. 18, 1980, abandoned.

[51] Int. Cl.[3] ..... D21D 3/00

[52] U.S. Cl. ..... 162/101; 162/190

[58] Field of Search ..... 162/101, 190, 289, 301, 162/317, 264

[56] References Cited

U.S. PATENT DOCUMENTS 3,871,952 3/1975 Robertson ..... 162/101

*Primary Examiner*—Peter Chin

*Attorney, Agent, or Firm*—William A. Aguele; Harry W. Hargis, III; Thomas H. Whaley

[57] ABSTRACT

Apparatus and method for the manufacture of a non-woven fibrous web such as paper from a dispersion of fibers in a foamed liquid. In a preferred embodiment, a solution of surfactant in water is initially discharged from a headbox into the nip of a twin forming wire prior to its passage over a curvilinear path defined by a forming roll. The water-surfactant solution is caused repeatedly to pass through the outer one of the twin forming wires until there is created, and stored in a silo, a foamed liquid containing about 65% air in the form of bubbles of from about 20 to about 200 microns in diameter. The foamed liquid is directed from the silo into a mix tank wherein a slurry containing fibers at 20% to 55% solids is added and mixed. The mixture is pumped to the headbox and into the nip of the forming wires. The outer wire retains the fibers while passing and again foaming the liquid for return to the silo and the mix tank for addition of fibers and return to the headbox. The process is continued in formation of a fibrous web.

In an alternative embodiment, the curvilinear path is defined by an arcuate surface that is fluid pervious so that the solution to be foamed may pass through both the inner and outer wires.

A further alternative embodiment utilizes a single forming wire for receiving the solution prior to passage over a suction breast roll which receives the solution then centrifuges it outwardly in formation of foamed liquid.

5 Claims, 5 Drawing Figures

APPARATUS AND METHOD FOR THE MANUFACTURE OF A NON-WOVEN FIBROUS WEB

This is a continuation of application Ser. No. 305,738, filed Sept. 25, 1981, now U.S. Pat. No. 4,443,297, which in turn is a divisional of Ser. No. 179,229, filed Aug. 18, 1980 (now abandoned).

BACKGROUND OF THE INVENTION

This invention relates to the forming of non-woven fibrous webs, such as paper and more particularly to an improved apparatus and method for the formation of such webs from a dispersion of fibers in a foamed liquid by depositing the liquid and fibers on a forming wire and draining the liquid through the wire to leave the fibers thereon in the form of a web.

The following U.S. patents are representative of the prior art, and are believed material to the examination of this application:

U.S. Pat. No. 3,716,449 discloses formation of a fibrous web, utilizing a dispersion of fibers in an aqueous foam produced in separate mixing units.

U.S. Pat. No. 3,938,782 discloses foamed liquid producing apparatus comprising an inlet and an outlet manifold connected by a plurality of nozzles and reaction tubes cooperatively disposed to generate fluid turbulence.

U.S. Pat. No. 3,871,952 discloses an optimum range of air content for a foamed liquid medium, surface active agents capable of producing the foamed medium, and recovery apparatus for reducing wastage of the surface active agent.

U.S. Pat. No. 3,837,999 discloses a separate foam generator, and a nozzle for directing a foam-fiber dispersion at the juncture of a pair of vertical forming screens.

These prior art patents have in common the teachings of separate foamed liquid generating systems, wherein liquid containing surface active agents are subjected to turbulence in the presence of air to create foam.

U.S. Pat. No. 3,876,498 discloses apparatus including a twin wire wrapped over an impervious breast roll for continuously forming a fibrous web from a slurry of fibers.

U.S. Pat. No. 3,846,232 discloses apparatus including a twin wire wrapped over a fluid pervious suction breast roll for continuously forming a fibrous web from a slurry of fibers.

U.S. Pat. No. 4,062,721 discloses addition of a surfactant to a wet fibrous sheet on a forming wire, and drawing a vacuum across the forming wire and fibrous sheet to form foam in the sheet for expelling water therefrom.

U.S. Pat. No. 3,746,613 discloses a twin wire paper making machine wherein the wires travel in an arc, and water escapes through both wires.

It is a general objective of the present invention to provide improved apparatus and method for the generation of a foamed liquid in a fibrous web forming system that does not require separate turbulence generating devices, yet achieves control of the foamed liquid as to desired air content, viscosity, specific gravity, and related characteristics.

It is a further objective to provide fibrous web forming apparatus including a forming surface, screen, or wire that functions as an element of a turbulence generator producing the foamed liquid.

It is a further and more specific objective to provide fibrous web forming apparatus of the twin forming wire type, wherein one of the forming wires is an element of a turbulence generator for producing foamed liquid within which fibers are dispersed for deposit on the forming wire.

SUMMARY OF THE INVENTION

In achievement of the foregoing as well as other objectives, the invention contemplates improvements in the manufacture of non-woven fibrous webs using forming wire means onto which a foamable-liquid alone initially is directed for passage therethrough to generate a foamed liquid, followed by dispersing dry fibers into the foamed liquid and depositing it on the wire means, and removing the liquid through the wire means to form a fibrous web and recycle the liquid into foamed liquid to receive more fibers for deposit on the forming wire means.

The manner in which the foregoing as well as other objectives and advantages of the invention may best be achieved will be more fully understood from a consideration of the following description, taken in light of the accompanying drawing.

DESCRIPTION OF THE SEVERAL EMBODIMENTS

Figure 1:
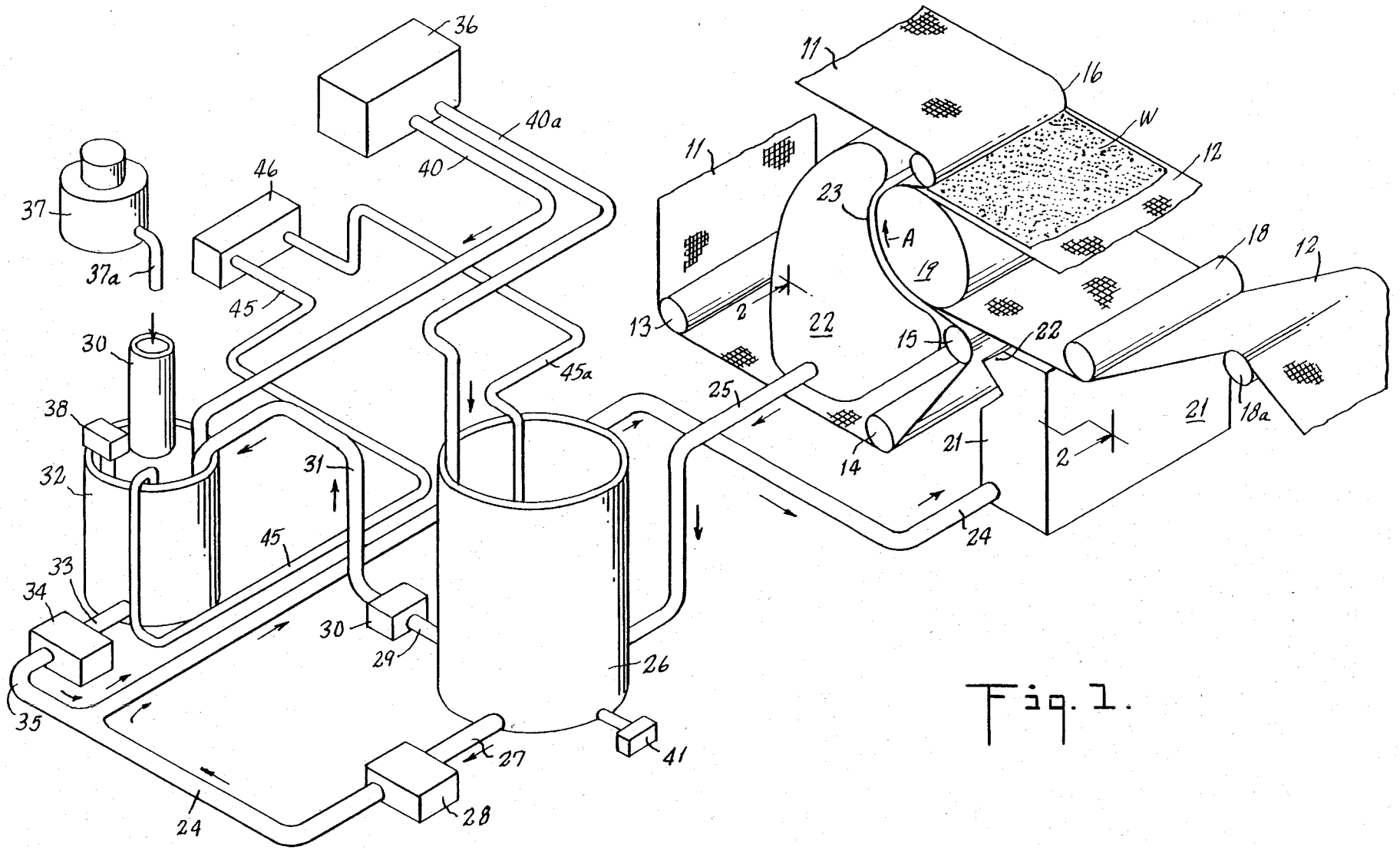
FIG. 1 is a somewhat diagrammatic perspective showing, with portions fragmented, of apparatus embodying the invention.

With more detailed reference to the drawing, and first to FIG. 1, a preferred embodiment of the invention comprises apparatus 10 of the twin-wire type for making a non-woven fibrous web, such as paper including forming wire means defined by first and second endless, woven, fluid permeable forming wires 11 and 12 of substantially similar weave and of the type used in the forming of non-woven webs. Forming wires 11 and 12 also are hereinbelow referred to as moving foraminous support means. Forming wire 11 is supported in conventional manner on rolls, including those designated generally by the numerals 13, 14, 15, and 16. Similarly, forming wire 12 is supported on rolls of conventional design, two of which are seen at 18 and 18*a*. The support rolls for forming wires 11 and 12 are so positioned as to cause them to wrap over an arcuate surface segment of a plain cylindrical forming roll 19. The wires 11 and 12 are driven so that the wrapped portions on forming roll 19 move undirectionally, at the same speed, in the direction of rotation A of roll 19.

Figure 2:
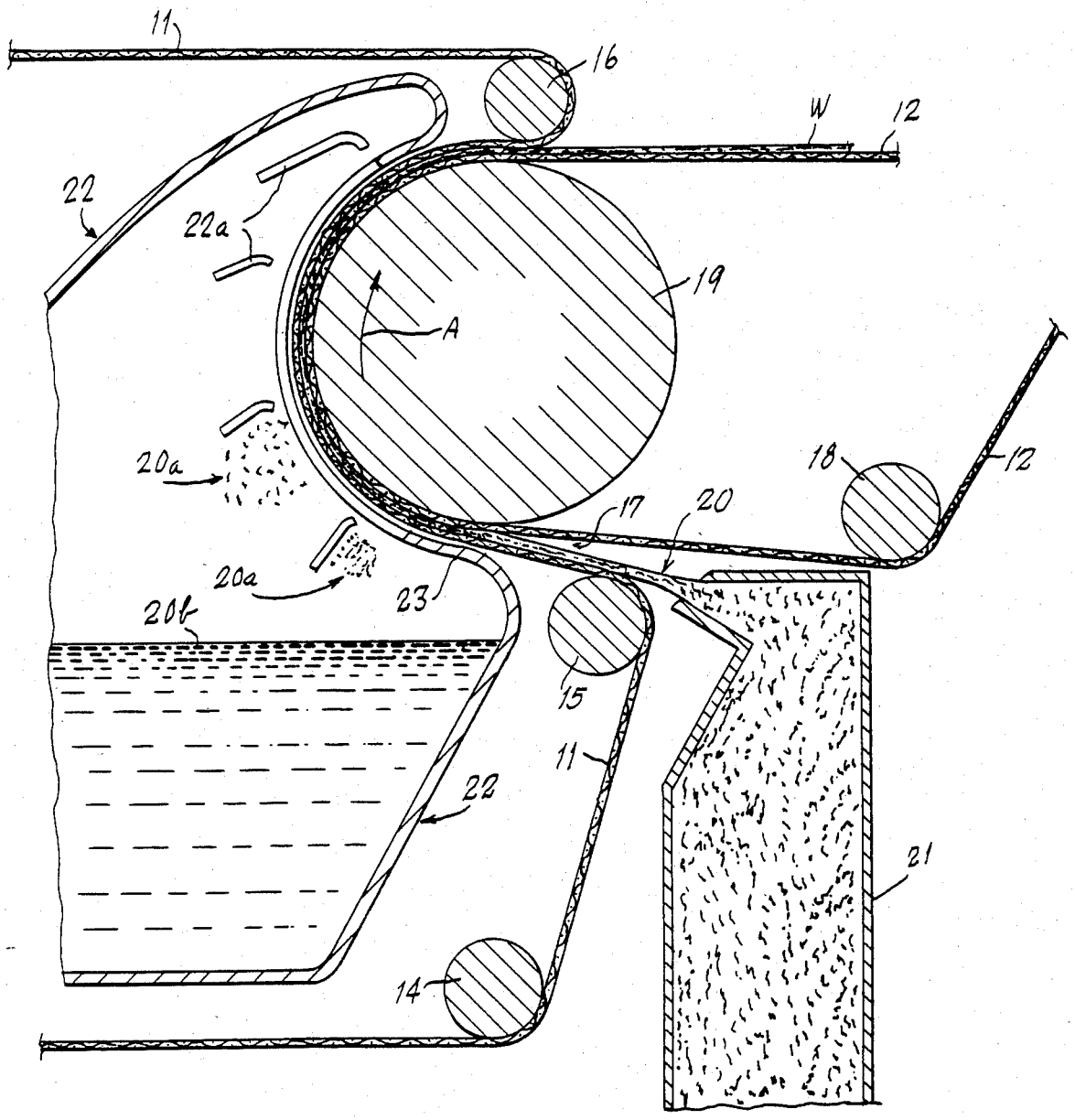
FIG. 2 is a sectional showing, also with portions fragmented, taken generally along the line 2—2 in FIG. 1, and looking in the direction of arrows applied thereto.

With reference also to the further showing of the preferred embodiment in FIG. 2, wires 11 and 12 tangentially engage the lower surface region of forming roll 19, at slightly different angles, to form a wedge-shaped space or zone therebetween into which is there directed a jet 20 of a foamed liquid-fiber dispersion from a headbox 21, for example a water headbox of conventional construction. The surface of roll 19 is smooth and fluid impervious, and wires 11 and 12 are so tensioned that they are operative to squeeze the foamed liquid-fiber dispersion and force liquid 20*a* through the wire 11, hereinbelow also referred to as the outer wire. Liquid 20*a* forced through the outer wire 11 is directed through the inlet port 23 of a saveall 22, and, with the aid of deflectors 22*a*, to collect therein as seen at 20*b*. Wire 12, hereinbelow also referred to as the inner wire, affords a backing and support for web W as it is carried away from the forming roll for further, conventional treatment. Alternatively, the support of web W may be afforded by wire 11, in which event the web would be carried from the forming roll in an opposite direction to that illustrated.

Further to the construction of apparatus 10, and again with reference to FIG. 1, the foamable liquid and fiber are supplied to headbox 21 through a conduit 24, and the residual liquid is withdrawn from saveall 22 through a conduit 25 connected in liquid flow circuit to the lower region of a foam silo 26. The same lower region of silo 26 is connected in series liquid flow circuit with a conduit 27, a pump 28, and conduit 24 leading to headbox 21. Disposed in parallel liquid flow circuit with conduit 27, pump 28 and a portion of conduit 24, is a liquid flow circuit including a conduit 29 connected to the bottom of foam silo 26, a pump 30, a conduit 31 leading into the top of mix tank 32, and a conduit 33 leading from the bottom of mix tank 32 and connected to conduit 24 through a pump 34 and a flow conduit 35. Water-surfactant solution is supplied to the mix tank 32 from a source 36 through conduit 40, and is supplied to silo 26 through branch conduit 40*a*. Pulp comprising fibers of the type used in paper making, is supplied to tank 32 through conduit 39 leading from a de-watering press 37 to which a pulp slurry is supplied from a suitable source. An agitator 38 is positioned and operative to mix the contents of tank 32, and an agitator 41 is provided for the contents of silo 26. The rate of pulp feed to the de-watering press is controlled to produce webs of the desired basis weight at the production speed of the machine. Typical basis weights are in a range of from about 8 lbs./ream (3000 $ft^2$) to about 38 lbs./ream,.

In a typical startup and web forming process, silo 26 and mix tank 32 are filled, through supply conduits 45, 45*a*, to about $\frac{1}{4}$ to about $\frac{1}{3}$ of capacity from a suitable water source 46. A concentrated aqueous solution of surfactant is added through conduits 40, 40*a* in an amount sufficient to give a predetermined surfactant concentration. For example an aqueous solution of a suitable anionic surfactant, such as alpha olefin sulphonate, available from Arco/Chemicals, Inc. under the trade mark A-OK, has been used to achieve a preferred concentration of about 300 ppm. A number of surfactants suitable as a water additive for purposes of the present invention are, of course, available on the market, being generally classified as nonionic, anionic, cationic, or amphoteric.

Selection of a class of surfactant is dependent upon chemical characteristics of such other additives as may be commonly used in the manufacture of fibrous webs. These other additives include, singly or in homogeneous mixtures thereof, latexes, binders, debonding agents, dyes, corrosion inhibiting agents, pH controls, retention aids, creping aids, and other substances such as are used in papermaking processes.

U.S. Pat. Nos. 3,716,449 and 3,871,952 disclose specific nonionic, anionic, and cationic surfactants that have been found suitable in the art of forming fibrous webs from dispersions of fibers in foam. U.S. Pat. No. 4,056,456 discloses additional surfactants, including some classified as amphoteric, that are suitable for practice of the present invention. The disclosures of these patents are included, by reference, in the present application for their teachings of surfactant materials. It is of course to be understood that there are a number of other additive surfactant materails available, each, as well as those identified, being capable of modifying the interfacial tension between water molecules and gas or air molecules of the liquid.

The forming section is then started, driving the forming wires 11 and 12 at a speed of about 2500 fpm, with the tension of the wires adjusted to about 30 pli, in a range of from about 20 pli to about 60 pli. The pumps 28, 30, and 34 are energized to pump surfactant solution, or foamable liquid, from silo 26 and mix tank 32 to headbox 21, from which jet 20 is directed into the juncture of the forming wires 11 and 12. The flow rate of liquid is regulated to achieve a jet velocity of from about 90% to about 150% of the speed of the forming wires. Typically, the speed of the jet is about 110% of the speed of the wires. Forming wire speeds in the range of from about 1000 fpm to about 7000 fpm or more are contemplated by the invention.

As the foamable liquid impinges on the forming wire 11, it is distributed over its surface, and the pressure created as the outer wire 11 moves onto the inner wire 12, combined with the force of liquid jet 20 on the outer wire, causes the foamable liquid to flow through interstices of outer wire 11 only, since the inner wire 12 has its interstices closed to fluid flow by the underlying solid surface of forming roll 19. Closure of the wires 11 and 12 taken with their linear movements and the force of impingement of liquid jet 20 on the wires, cooperate to produce combined compressive and shear forces on the liquid passing through the outer wire to a degree sufficient to entrain air traveling with the wire as well as air in its interstices, advantageously to generate the desired foamed liquid, hereinbelow also identified by the term foam.

Foam 20*a* is collected in saveall 22 and supplied to the lower region of silo 26 by way of conduit 25. The foam is pumped again, in continuous cyclic manner, from the lower region of silo 26 and mixing tank 32 to headbox 21, for passage through wire 11 and return to the silo and the tank, whereby over an operating period of about 5 min. the air content of the liquid is increased from about 0% to a preferred value of about 67%. Also, maximum bubble size is, for example, in a range from about 20 microns to about 200 microns, less than the lengths of the suspended fibers. Optimum relationships of bubble dimension to fiber dimensions are dealt with in the referenced U.S. Pat. Nos. 3,716,449 and 3,871,952, and are achieved by the apparatus and method of the present invention.

While the hereinabove described cyclic operation continues, fiber is introduced from dewatering press 37 to mix tank 32 at a rate corresponding to the desired web production rate. In achievement of the desired rate, a slurry of about 3% fibers is fed to press 37, and a slurry of from about 25% to about 50%, for example 35%, leaves the press for feed to mix tank 32. It will of course be understood that the invention contemplates that fibers may be introduced directly, in a dry state, to the foamed liquid, in suitable proportions for achieving desired basis weights. With all pumps energized, the foam-fiber mixture is directed by pump 34 from mix tank 32, through conduits 33, 35, into conduit 24, where it combines with foam directed by pump 28 from silo 26, through conduits 27 and 24, for flow to headbox 21, and onto wires 11 and 12. Fibers, and some foam, remain on the wires, the major portion of the foam passing through wire 11 whereby it is regenerated by having its air content increased. Control of air content is achieved in part by passing the collected foam from saveall 22, through conduit 25, into the lower region of silo 26 where foamed liquid in excess of 75%. Air content because of its characteristically large sized bubbles, will stratify in the silo as an upper, frothy layer of foamed liquid. Since the large bubbles are low in foamable liquid content, they tend to collapse and the liquid forming their walls returns to the overall volume of liquid for recycling to make up the desirable, lesser-sized bubbles. Dwell or retention time of foam in the silo is about $\frac{1}{3}$ minute, and removal of excess air and replenishment of lost foamable liquid, through supply conduit 35 are readily achieved in this time period.

A loss of foam occurs following the introduction of fiber and its deposition on the forming wires, since liquid is removed from the closed system along with the fiber as it is formed into web W. The foamable liquid lost in this manner is continuously replenished, the water being replenished through supply conduits 45 and 45*a*, and the surfactant solution being replenished through supply conduits 40 and 40*a*, thereby further aiding in maintaining air content of the foam in a desired range of from about 55% to about 75%. For example, an increase in surfactant concentration to 340 ppm of the foamable liquid when replenishing the lost liquid, in combination with removal of large-size bubbles has been found to maintain air content at the preferred value of about 67%. It is well known in the art, as exemplified by the referenced U.S. Pat. Nos. 3,716,449 and 3,871,952, that air content below about 55% is conducive to fiber agglomeration, and air content above about 75% is conducive to fiber bundling, both undesirable.

Control of air content is therefore achieved by maintaining a predetermined concentration of surface active agent in the foamable liquid in combination with maintaining a predetermined dwell time. By controlling in this manner, air content of the foam can be held substantially constant, without need for metering of air by separate means.

From the foregoing description of the preferred embodiment, it will be appreciated that the invention represents an important advance in the art of fibrous web manufacture from a dispersion of fibers in foam, wherein there is eliminated need for costly and elaborate foam generating systems. It will also be appreciated that the invention affords operation at relatively higher forming wire speeds since the higher the speed the more air and shearing forces there are available using the wire as an element of the foam generator. Also, air content can be readily controlled by varying the concentration of the surface active agent in the foamable liquid.

Figure 3:
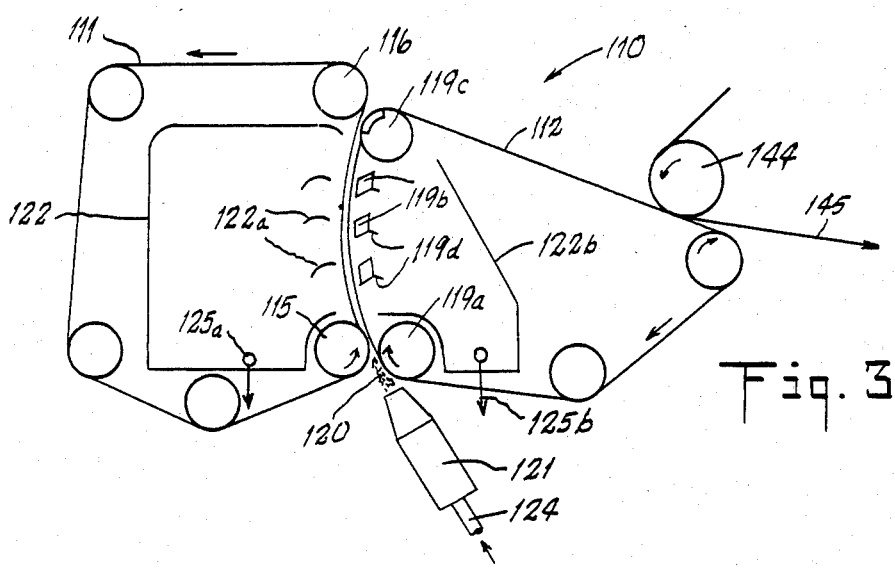
FIGS. 3 to 5 are diagrammatic showings, similar to FIG. 2, of modified embodiments of the invention.

There is seen in FIG. 3 a modified embodiment of the invention, particularly adapted to the manufacture of heavy weight webs, wherein apparatus 110 includes twin forming wires 111 and 112 supported for linear movements on rolls of the type seen at 115,116 and 119*a*, 119*c*, respectively. The support rolls for wires 111 and 112 are so positioned as to cause them to follow an arcuate path defined by the spaced, curved surfaces of forming shoes 119*b*, each provided with a foil 119*d*. An endless web transfer medium 145 wraps around a portion of a roll 144, and is tangent to forming wire 112.

A set of foils 122*a* are disposed opposite shoes 119*b*, on the convex side of the arcuate run of wires 111 and 112. A headbox 121 is supplied a foamed liquid-fiber dispersion from conduit 124, and is operative to direct a ribbon-like jet 120 of the dispersion into the nip of forming wires 111, 112. Further to apparatus 100 a saveall 122 is associated with vanes 122*a*, and a saveall 122*b* is associated with forming shoes 119*b* and vanes 119*d*, the savealls being drained by respective conduits 125*a* and 125*b*.

In operation, forming wires 111 and 112, and endless web transfer medium 145, are driven in unison over their support rolls, in the direction of arrows applied thereto. At the same time the jet 120 of foamed liquid-fiber dispersion is fed into the juncture zone of the wires. The dispersion is drawn, in continuous fashion, through the arcuate region of the wires, where liquid is thrown out centrifugally, and directed by foils 122*a* into saveall 122. At the same time, liquid is drawn out to the concave side of the curved wire region, by vacuum shoes 119*b*, and, with the aid of foils 119*d*, is directed into saveall 122*b*. The liquid, of course, in being forced through the forming wires, is again converted to a foamed liquid and is returned from the savealls to the silo (not shown) through conduits 125*a* and 125*b*. As the fibrous web exits the curved wire region, i.e. forming zone, it is drawn by roll 119*c*, a vacuum transfer roll, onto wire 112, where it continues to, and is removed by, the endless web transfer medium 145.

Figure 4:
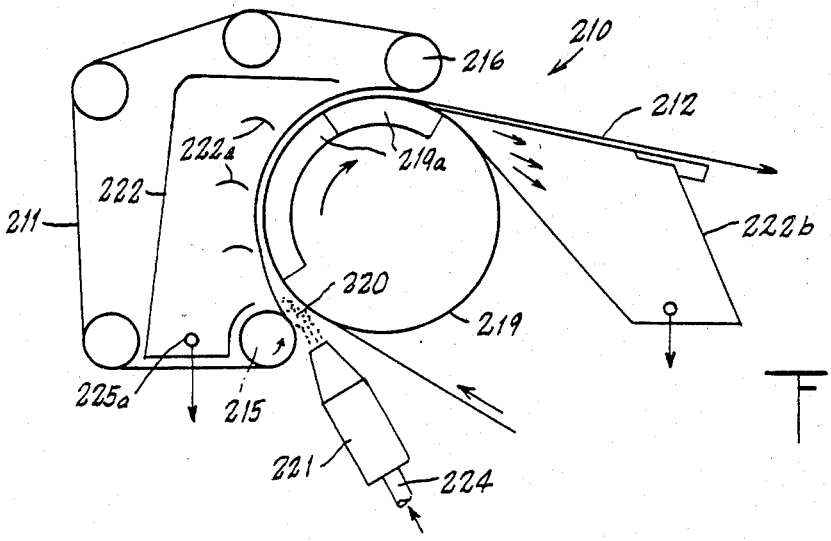

A further modified embodiment of the disclosed twin wire apparatus is seen in FIG. 4, wherein apparatus 210 includes a pair of forming wires 211 and 212. Wire 211 is supported on conventional rolls, two of which are designated 215 and 216. Similarly, wire 212 is supported on rolls (not shown) of conventional design. Both wires 211 and 212 are further supported partially to wrap around an open forming cylinder 219, so that in a lower region of wrap, they tangentially engage roll 219 at slightly different angles to form a wedge-shaped zone therebetween. A jet 220 of a foamed liquid-fiber dispersion is directed into the zone from a headbox 221 supplied by a conduit 224. The roll 229 is a hollow cylinder, and, as will be described in more detail in connection with the embodiment shown in FIG. 4, has outer surface pockets covered by a screen, and which pockets are subject to a vacuum produced by vacuum boxes 219*a* inside the roll. A saveall 222 and its foils 222*a* are positioned to receive liquid centrifuged through the curved section of wire 211. A saveall 222*b* is positioned to receive fluid thrown from beneath wire 212 and out of the roll pockets through its screen cover. The liquid in passing through the wire and screen is transformed into foamed liquid, which is returned to the silo through conduits 225*a* and 225*b*.

Figure 5:
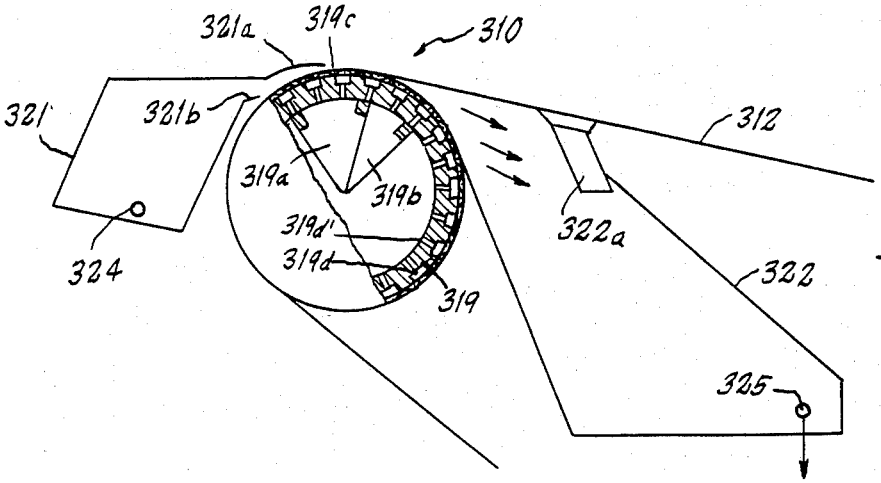

A departure from the twin forming wire is seen in FIG. 5, wherein apparatus 310 of the suction breast roll type has a forming wire 312 wrapped partially thereabout and supported for drive therewith and about additional rolls (not shown) of known construction. A headbox 321 is fed a foamed liquid-fiber dispersion through conduit 324, and is positioned and operative to discharge this same dispersion through an elongate opening defined by an upper, curved wall 321*a* and a lower, apron lip 321*b*. A saveall 322 is positioned with its opening just below the region of the forming wire 312 tangent to and downstream of the roll 319.

Further to the construction of roll 319, it is a hollow cylinder provided with a large number of perforations defined by large diameter outer bores 319*d* and lesser diameter inner bores 319*d'*, the bores being coaxial and whose axes extend radially of the roll 319. A fine mesh screen 319*c* extends about and closely overlies the perforate outer surface of the roll. Inside the rolls are a pair of low pressure zones 319*a* and 319*b* defined by suitable baffling and vacuum producing means (not shown) of known construction. Disposition of the baffling is such that the portion of the roll 319 underlying the elongate discharge opening of the headbox is subject to low pressure zone 319*a*. The portion of the roll between the edge of wall 321*a* and the line of departure of wire 312 from the roll is subject to low pressure zone 319*b*. A foil 322*a* on saveall 322 is positioned to ensure removal of liquid from the underside of wire 312 as it carries the fibrous web away from the breast roll for subsequent treatment.

In operation, foamed liqid-fiber dispersion is fed by headbox 321 onto forming wire means including wire 312 and underlying screen 319*c* on the surface of breast roll 319, and liquid is withdrawn by vacuum zone 319*a* through both the wire and the screen, whereupon it is stored in bores 319*d*. As roll 319 rotates, the formed web is moved over vacuum zone 319*b* where it is held on wire 312 and the liquid is held in bores 319*d*. Upon continued rotation of roll 319, wire 312 parts from the surface of the roll, creating a vacuum to force additional liquid from the web and permitting the liquid stored in bores 319*d* to be centrifuged outwardly through screen 319*c* into saveall 322. The passage of the liquid through screen 319*c* and through wire 312 advantageously transforms the liquid into foamed liquid for return to the silo (not shown) through conduit 325.

From the foregoing it will be appreciated that the invention advantageously affords, both in its apparatus and process aspects, continuous operation without loss of fluid as sewage, thereby eliminating need for costly effluent treatment plants, as well as reducing the need for surface active agent makeup.

While preferred and alternative method and apparatus aspects of the invention have been described, it will be appreciated that the invention is susceptible of such modifications as may fall within the scope of the appended claims.

We claim:

1. A method for the production of non-woven fibrous web on a moving foraminous support which comprises:

a. forming a foamed fiber furnish by dispersing fibers in a foamed liquid comprising water and a surface active agent containing 55 to 75 percent air by volume and capable of supporting and transporting fibers as a dispersion therein;

b. supplying said foamed fiber furnish to a moving foraminous support web-forming means without substantial further turbulence or agitation effecting formation of said web whereby air is entrained in foamed liquid passing through said foraminous support;

c. collecting foamed liquid passing through said foraminous support;

d. storing said collected foamed liquid for a period of time sufficient to permit said foamed liquid to stratify into an upper frothy layer and a lower more dense layer of foamed liquid containing 55 to 75 percent air by volume capable of supporting and transporting fibers as a dispersion therein;

e. separating said more dense layer of foamed liquid containing from about 55 to about 75 percent air by volume from said frothy layer of less dense foam; and f. recirculating said more dense layer of foamed liquid directly to step a. for the preparation of said foamed fiber furnish.

2. A method according to claim 1 wherein said foamed liquid is stored for a period of about one-third of a minute.

3. A method according to claim 1 wherein said air in said foamed liquid making up said foamed fiber furnish is in the form of bubbles having an average diameter in the range of from about 20 to about 200 microns.

4. A method according to claim 1 wherein said foamable liquid is brought into contact with said moving foraminous support as a jet of liquid having a velocity in the range of 90 to about 150 percent of that of said moving foraminous support.

5. A method according to claim 4 wherein the velocity of said jet is about 110 percent of that of said moving foraminous support.

* * * * *